US005565299A

United States Patent [19]

Gibson et al.

[11] Patent Number: 5,565,299

[45] Date of Patent: Oct. 15, 1996

[54] PROCESSES FOR LIQUID DEVELOPER COMPOSITIONS

[75] Inventors: George A. Gibson, Fairport, N.Y.; Peter G. Odell, Mississauga, Canada; James R. Larson, Fairport, N.Y.

[73] Assignee: Xerox Corporation, Stamford, Conn.

[21] Appl. No.: 496,751

[22] Filed: Jun. 29, 1995

[51] Int. Cl.[6] ..... G03G 9/12

[52] U.S. Cl. ..... 430/137

[58] Field of Search ..... 430/137, 115

[56] References Cited

U.S. PATENT DOCUMENTS

| | | | |
|---|---|---|---|
| 4,923,778 | 5/1990 | Blair et al. | 430/137 |
| 5,017,451 | 5/1991 | Larson et al. | 430/137 |
| 5,019,477 | 5/1991 | Felder | 430/115 |
| 5,223,368 | 6/1993 | Ciccarelli et al. | 430/110 |
| 5,387,489 | 2/1995 | Fuller et al. | 430/137 |

*Primary Examiner*—John Goodrow
*Attorney, Agent, or Firm*—E. O. Palazzo

[57] ABSTRACT

A process for the preparation of liquid developers comprising forming a heated dispersion of colorant, thermoplastic resin and carrier liquid, and charge control agent, followed by subsequent cooling of the resulting molten mixture under high shear.

19 Claims, No Drawings

PROCESSES FOR LIQUID DEVELOPER COMPOSITIONS

BACKGROUND OF THE INVENTION

This invention is generally directed to liquid developer compositions and, more specifically, the present invention relates to processes for the preparation of liquid developers. More specifically, the present invention relates to a continuous process for the preparation of liquid developers comprised of liquid carrier, charge director, resin, carrier liquid, colorant, especially pigment, charge control agent, and optionally charge director and charge adjuvant, and wherein grinding is avoided thereby eliminating or minimizing contamination of the resulting developer by, for example, grinding media such as steel balls. In embodiments, the process of the present invention comprises the generation of a dispersion by extrusion of pigment and charge control agent in a toner resin, such as a thermoplastic resin, and subsequently cooling the molten mixture resulting under high shear to enable fine particles in a carrier fluid. Advantages associated with the economical processes of the present invention include permitting the direct preparation of high solids contents liquid developers, for example about at least 35 percent of solids and a reduction in process time. The developers of the present invention can be selected for a number of known imaging systems, such as xerographic imaging and printing processes, wherein latent images are rendered visible with the liquid developers illustrated herein. Charge control agents are considered soluble in the carrier liquid and they can charge the toner directly; charge adjuvants are soluble in the carrier liquid and increase the charge on the toner; and charge control additives are bound to the toner particle during use and can increase the charge on the toner.

A latent electrostatic image can be developed with toner particles dispersed in an insulating nonpolar liquid. The dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to an intermediate, or a receiver sheet.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm (microns) average by area size as measured with the Malvern 3600E particle sizer.

Since the formation of proper images depends primarily on the difference of the charge between the toner particles in the liquid developer and the latent electrostatic image to be developed, it is desirable to add a charge director compound and optional charge control agents, or charge adjuvants which increase the magnitude of the charge, such directors being, for example, polyhydroxy compounds, amino alcohols, polybutylene succinimide compounds, metallic soaps, and the like, to the liquid developer comprising the thermoplastic resin, the nonpolar liquid and the colorant.

Processes for the preparation of liquid electrostatic developer of the present invention include, for example, mixing, in a nonpolar liquid with the thermoplastic resin, charge control agent, and colorant like pigment in a manner that the resulting mixture contains about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding a charge director compound to the dispersion; and diluting the dispersion to 1 percent to 2 percent solids; and wherein the resin, pigment and charge control agent are dispersed in the liquid and charge director mixture.

In the initial mixture, the resin, colorant and charge control agent may be added separately to an appropriate vessel which can vary in size from 50 milliliters to 1,000 liters, such as, for example, an attritor, heated ball mill, heated vibratory mill, such as a Sweco Mill (manufactured by Sweco Company, Los Angeles, Calif.) equipped with particulate media for dispersing and grinding, a Ross double planetary mixer (manufactured by Charles Ross and Son, Hauppauge, N.Y.), or a two roll heated mill, which requires no particulate media. Useful particulate media include materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, charge control agent, and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes. After grinding at the above temperatures, an additional amount of nonpolar liquid may be added to the dispersion. The amount of nonpolar liquid to be added at this point should be an amount sufficient to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778 and 4,783,389, the disclosures of which are totally incorporated herein by reference.

There is illustrated in U.S. Pat. No. 4,923,778, a process for the preparation of high solids liquid developers wherein grinding media are selected and thus contiminate the resulting developer, a problem avoided with the processes of the present invention. The aforementioned contimination adversely affects the developer characteristics obtained including, for example, causing arcing between the image bearing member surface and the reverse roller, causing scratching and premature wear of the image bearing member and other wetted rotating components present in the liquid development apparatus.

In U.S. Pat. No. 5,035,972, the disclosure of which is totally incorporated herein by reference, there are illustrated liquid developers with quaternized ammonium AB diblock copolymer charge directors, and wherein the nitrogen in the ionic A block is quaternized with an alkylating agent and processes thereof.

U.S. Pat. No. 5,019,477, the disclosure of which is hereby totally incorporated by reference, illustrates a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors such as cobalt and iron naphthenates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) selected from the group consisting of vinyl toluene and styrene, and (iv) selected from the group consisting of butadiene and acrylate. A copolymer of polyethylene and methacrylic acid or methacrylic acid alkyl esters, NUCREL®, may also be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. These liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

In U.S. Pat. No. 4,707,429, there are illustrated, for example, liquid developers with an aluminum stearate charge adjuvant. Liquid developers with certain charge directors are illustrated in U.S. Pat. No. 5,045,425.

In U.S. Pat. No. 5,306,591 and U.S. Pat. No. 5,308,731, the disclosures of which are totally incorporated herein by reference, there is illustrated a liquid developer comprised of thermoplastic resin particles, a charge director, and a charge adjuvant comprised of an imine bisquinone; and a liquid developer comprised of a liquid, thermoplastic resin particles, a nonpolar liquid soluble charge director, and a charge adjuvant comprised of a metal hydroxycarboxylic acid, respectively and processes thereof. In U.S. Statutory Invention Registration No. H1483, the disclosure of which is totally incorporated herein by reference, there is illustrated a liquid developer comprised of thermoplastic resin particles, and a charge director comprised of an ammonium AB diblock copolymer of the formula

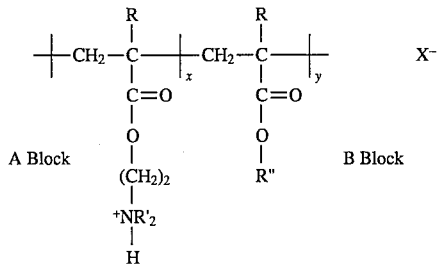

wherein X— is a conjugate base or anion of a strong acid; R is hydrogen or alkyl; R' is alkyl; R" is an alkyl group containing from about 6 to about 20 carbon atoms; and y and x represent the number average degree of polymerization (DP) wherein the ratio of y to x is in the range of from about 10 to 2 to about 100 to 20.

SUMMARY OF THE INVENTION

It is an object of the present invention to provide a liquid developer with many of the advantages illustrated herein.

Another object of the present invention resides in economical processes for obtaining liquid developers with a high solids content and a desirable size, and wherein grinding medium are avoided.

It is a further object of the invention to provide charged liquid developers wherein there are selected as insoluble charge control agents, or charge additives quaternary polyammonium salts, and which developers have a solids content of at least 40 percent and a size of from about 1 to about 3 microns in average volume diameter.

It is still a further object of the invention to provide processes for liquid developer wherein developed image defects, such as smearing, loss of resolution and loss of density, are eliminated, or minimized, and wherein there are selected economical charge components that permit toners that can be easily transferred from imaging members, such as photoreceptor drums, and which process comprises a continuous precipitation.

Also, in another object of the present invention there are provided positively charged liquid developers with certain charge adjuvants.

Another object of the present invention resides in the provision of liquid developers with known additives and certain quaternary ammonium polymer adjuvants; and wherein the resulting liquid developers minimize the charging tendencies of the pigments selected, and wherein these adjuvants are not leached into the hydrocarbon liquid or charge director.

These and other objects of the present invention can be accomplished in embodiments by the provision of liquid developers. In embodiments, the present invention is directed to continuous processes for the preparation of liquid developers comprised of a toner resin, pigment, and a charge control agent comprised, for example, of certain quaternary polyammonium compounds wherein the quaternary polyammonium compound is comprised of from about 0.1 to about 20 weight percent and preferably from about 1 to about 10 weight percent of the toner composition, and wherein the ammonium repeat unit composition in the quaternary polyammonium polymers is from about 5 to about 100 weight percent and preferably from about 20 to about 100 weight percent. The quaternary polyammonium polymer may be random, blocked or segmented.

The process of the present invention in embodiments comprises mixing under high shear in a continuous processing device, like a Teledyne Readco continuous processor, single or twin screw extruder and with no grinding medium, resin, colorant, and charge control agent or additive and carrier fluid at a temperature sufficient to fluidize the mixture resulting. Mixing is accomplished until the desired degree of compositional homogeneity, including in embodiments pigment dispersion, is obtained.

In embodiments the solid components of resin, colorant and charge control additive can be combined with the above mixing and dispersion followed by the addition of carrier liquid. The solids content thereof is in excess of about 25 percent, and for example, is preferably from about 25 to about 50 percent. Thereafter, the mixture resulting is passed through a high shear device which contains no grinding media. The mixture is cooled and there results solids comprised of resin, pigment, and charge control additive. The aforementioned toner particles may be swollen by adding carrier liquid. High shear device examples include single and twin extruders, the Teledyne-Readco continuous processor, and the like.

Examples of components that may be selected for the processes of the present invention are illustrated, for example, in U.S. Pat. No. 5,047,307, the disclosure of which is totally incorporated herein by reference.

In embodiments, the processes of the present invention enable liquid developers comprised of a toner resin, colorant, and a charge control agent of, for example, quaternary polyammonium compounds including preferably poly(styrene-co-N,N,N-trimethylammonium-N-2-ethyl methacrylate tosylate), poly(4-vinylpyridine-co-4-vinyl-N-methylpyridinium bromide), poly(2-hydroxyethyl methacrylate-co-N,N,N-trimethylammonium-N-2 -ethyl methacrylate chloride), poly(N,N-dimethyl- 3,5-dimethylenepiperidinium chloride), and the like dispersed in a mixture of a liquid and a charge director. The polyammonium charge adjuvant compounds can be prepared by polymerization of amine containing monomers alone or with suitable nonamine containing comonomers. The amine monomers include 2-dimethylaminoethyl methacrylate, 2-dimethylaminoethyl acrylate, 2-t-butylaminoethyl methacrylate, 4-vinylpyridine, 2-vinyl pyridine, 3-dimethylaminopropyl methacrylamide, 4-vinyl-N,N-dimethylaniline, 4-vinyl-N,N-dimethylamino-alpha toluene, diallylamine, N-methyldiallylamine, ethylenimine, propylenimine, N-substituted ethylene and propylene imines, vinylamines and substituted vinylamines, aluminum stearate aluminum bis(3,5 di-t-butylsalicylate), and the like in the concentration range of about 0.5 to 10 percent by weight of solids.

The present invention in embodiments is directed to a process for the preparation of liquid developers comprising forming a heated dispersion of colorant, thermoplastic resin and optional carrier liquid, and charge control agent, followed by subsequent cooling of the resulting molten mixture under high shear.

Embodiments of the present invention include a liquid developer comprised of thermoplastic resin particles, and a known charge control agent; a liquid developer comprised of a liquid component, thermoplastic resin, and pigment; a charge control agent; a charge director compound as illustrated herein; and wherein the charge adjuvant agent, resin and pigment are dispersed in the liquid component charge director mixture; and a positively charged liquid electrostatographic developer comprised of (A) a liquid having viscosity of from about 0.5 to about 20 centipoise and resistivity greater than $5\times10^9$; (B) thermoplastic resin particles with an average volume particle diameter of from about 0.1 to about 30 microns, pigment, and charge control agent; (C) a known charge adjuvant like aluminum stearate, and wherein the charge adjuvant is associated with or combined, preferably permanently, with the resin and pigment; and (D) a charge director compound.

In embodiments, the processes of the present invention enable liquid developers with a high solids content of 50 to 75 percent and with a size diameter of, for example, 1 to 3 microns, and which developers are comprised of thermoplastic resin particle, and a charge control agent, and wherein the charge control agent is associated with or combined with the resin particles.

In embodiments, it is important that the toner particles be comprised of the thermoplastic resin, the charge control agent, and pigment. Therefore, it is important that the thermoplastic resin and the charge control agent be sufficiently compatible that they do not form separate particles and that the charge control agent be substantially insoluble in the hydrocarbon selected to the extent that not more than about 0.1 weight percent be soluble in the nonpolar liquid in embodiments.

The charge director can be selected for the liquid developers in various effective amounts such as, for example, in embodiments from about 5 to 1,000 milligrams of charge director per gram of toner solids and preferably 10 to 100 milligrams/gram. Developer solids include toner resin, pigment, and charge adjuvant. Without pigment, the developer may be selected for the generation of a resist, a printing plate, and the like.

Examples of effective charge directors for positive liquid toner particles include anionic glyceride, such as EMPHOS® D70-30C and EMPHOS® F27-85, two products available from Witco Corporation, New York, N.Y., which are sodium salts of phosphated mono- and diglycerides with saturated and unsaturated substituents, respectively, lecithin, Neutral Barium Petronate, Calcium Petronate, Neutral Calcium Petronate, oil soluble petroleum sulfonates, Witco Corporation, New York, N.Y., and metallic soap charge directors such as aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmitate; calcium, cobalt, manganese, lead, and zinc resinates; hydroxy bis[3,5-tertiary butyl salicylic] aluminate monohydrate, and the like. Other effective positive charge directors include AB diblock copolymers of 2-ethylhexylmethacrylate-co-methacrylic acid calcium and ammonium salts as illustrated in U.S. Pat. No. 5,130,221, the disclosure of which is totally incorporated herein by reference.

Examples of liquid carriers, or nonpolar liquids selected for the processes and developers of the present invention include a liquid with an effective viscosity as measured, for example, by a number of known methods such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon as illustrated herein. A nonpolar liquid of the ISOPAR® series, available from Exxon Corporation, may also be used for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR®M has a flash point of 80° C. as determined by the ASTM D-56 method. The liquids selected should have an electrical volume resistivity in excess of $10^9$ ohm-centimeters and a dielectric constant below 3.0. Moreover, the vapor pressure at 25° C. should be less than 10 Torr in embodiments. The amount of liquid carrier or nonpolar liquid is 75 to 99.9 weight percent and preferably between 95 and 99 weight percent.

In embodiments, the ISOPAR® series liquids are the preferred nonpolar liquids for use as dispersants in the liquid developers of the present invention; the essential characteristics of viscosity and resistivity may be achieved with other suitable liquids. Specifically, the NORPAR® series available from Exxon Corporation, the SOLTROL® series available from the Phillips Petroleum Company, and the SHELLSOL® series available from the Shell Oil Company can be selected.

Typical suitable thermoplastic toner resins can be selected for the liquid developers of the present invention in effective amounts of, for example, in the range of about 99 percent to about 40 percent, and preferably about 95 percent to about 70 percent of developer solids comprised of thermoplastic resin, colorant, such as pigment, charge control agent and in embodiments other optional components, such as magnetic materials like magnetites that may comprise the developer. Generally, developer solids include the thermoplastic resin, pigment and charge adjuvant. Examples of thermoplastic resins include ethylene vinyl acetate (EVA) copolymers, (ELVAX® resins, E.I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid (optional but preferred), and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers selected in embodiments are comprised of the copolymer of ethylene and an α-β-ethylenically unsaturated acid of either acrylic acid or methacrylic acid. In a preferred embodiment, NUCREL® resins available from E.I. DuPont de Nemours and Company like NUCREL 599®, NUCREL 699®, or NUCREL 960® are selected as the thermoplastic resin.

The liquid developer of the present invention preferably contains a colorant and known charge control agents like organo aluminum compounds like ALHOS, reference for example U.S. Pat. No. 5,223,368, the disclosure of which is totally incorporated herein by reference, dispersed in the resin particles. Colorants, such as pigments or dyes like black, cyan, magenta, yellow, red, blue, green, brown, and mixtures thereof can be selected wherein any one colorant may comprise from 0.1 to 99.9 weight percent of the colorant mixture with a second, or other additional colorants comprising the remaining percentage thereof.

The colorant may be present in an effective amount of, for example, from about 0.1 to about 60 percent, and preferably from about 10 to about 30 percent by weight based on the total weight of solids contained in the developer. The amount of colorant used may vary depending on the use of the developer, for example when the toned image is selected for the formation of a chemical resist image no colorant like pigment is necessary. Examples of pigments which may be selected include carbon blacks available from, for example, Cabot Corporation (Boston, Mass.), such as MONARCH 1300®, REGAL 330® and BLACK PEARLS®, and color pigments like FANAL PINK™, PV FAST BLUE™, and Paliotol Yellow D1155; pigments as illustrated in U.S. Pat. No. 5,223,368, the disclosure of which is totally incorporated herein by reference.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning. Toner particle mobility can be measured using the electroacoustics effect, the application of an electric field, and the measurement of sound described in U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is for example high mobilities have been shown to result in improved image density, higher image resolution and superior transfer efficiency, for example U.S. Pat. Nos. 5,066,821, 5,034,299, and 5,028,508, the disclosures of which are totally incorporated herein by reference. Residual conductivity, that is the conductivity from the charge director, can be measured with a low field device as described in the Examples.

To increase the toner particle charge and, accordingly, increase the mobility and transfer latitude of the toner particles, certain charge directors can be added to the toner particles, examples of which include poly(styrene-co-4-vinyl-N-methylpyridinium chloride), poly(styrene-co-4 -vinyl-N-methylpyridinium bromide), poly(styrene-co-4-vinyl-N-methylpyridinium tosylate), poly(2-ethylhexyl methacrylate-co-N,N,N-trimethylammonium-N-2 -ethyl methacrylate bromide), poly(2-ethylhexyl methacrylate-co-N,N,N-trimethylammonium-N-2-ethyl methacrylate nitrate), poly(2-ethylhexyl methacrylate-co-N,N,N-triethylammonium-N-2-ethyl methacrylate chloride), poly(n-butylmethacrylate-co-N,N,N-triethylammonium-N-2-ethyl methacrylate chloride), poly(styreneoco-N,N,N-trimethylammonium-N-2 -ethyl methacrylate tosylate), poly(4-vinyl-N-methylpyridinium bromide), poly(4 -vinyl-N-methylpyridinium chloride), poly(4-vinyl-N-methylpyridinium tosylate), poly(2 -hydroxyethyl-methacrylate-co-N,N,N-trimethylammonium-N-2-ethyl methacrylate chloride), poly(2-hydroxyethyl methacrylate-co-4-vinyl-N-methylpyridinium chloride), poly(2-hydroxyethyl methacrylate-co-4-vinyl-N-methylpyridinium bromide), poly(2-hydroxyethyl methacrylate-co-4-vinyl-N-methylpyridinium tosylate), poly(N,N-dimethyl-3,5-dimethylenepiperidinium chloride), and the like. The adjuvants can be added to the liquid toner particles in an amount of from about 0.1 percent to about 20 percent of the total developer solids of toner resin, pigment, and charge control agent, and preferably from about 1 percent to about 10 percent of the total weight of solids contained in the developer.

The conductivity of the liquid toner dispersions and charge director solutions can be determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to provide an ESA signal corresponding to a zeta potential of –26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 centrifugal automatic particle analyzer manufactured by Horiba Instruments, Inc., Irvine, Calif.

Image quality of the developers of the invention was determined on a Savin 870 copier modified as follows 1) disconnecting the image density feedback loop from the development electrode and connecting the electrode to a Trek Model 610 high voltage power supply (Trek, Medina, N.Y.), and 2) disconnecting the transfer corona and connecting same to a Trek Model 610 high voltage power supply (Trek, Medina, N.Y.).

To evaluate positive developers, this system was operated with a reverse image target with white characters on a black background such that the image had a positive voltage less than the development voltage and the background had a positive voltage greater than the image voltage thus resulting in the positive particles being pushed selectively onto the image area. Development voltage ranged form 500 to 1,000 volts. Transfer to paper was conducted at –6,500 volts.

EXAMPLES I to IV

Hot Stage Extrusion—Two Pass Process

The developer was prepared by dry mixing NUCREL 599® (a copolymer of ethylene and methacrylic acid with a melt index at 190° C. of 500, available from E.I. DuPont de Nemours & Company, Wilmington, Del.), pigment and internal charge additive, or charge control agent, bis(3,5-di-t-butylsalicylato) aluminum hydroxide, in the proportions given in the Table below. This blend was then fed into Werner and Pfleiderer ZSK30 twin screw extruder at 10 pounds/hour. The extruder barrel temperature profile was 150°/130°/130°/130°/130°/130°/140°/150° C. for Example I and 140°/130°/100°/100°/100°/100°/120°/130° C. for Examples II to IV, and the screw speed was 300 rpm in all cases. The extruded strands were cooled in a water tank, dried and pelletized.

| TONER ID | PIGMENT | FORMULATION (RESIN:PIGMENT:CCA BY WEIGHT) |
|---|---|---|
| Example I (40420) | PALIOTOL YELLOW | 74:25:1 |
| Example II (40428) | FANAL PINK | 77:22:1 |
| Example III (40628) | PV FAST BLUE | 77:22:1 |
| Example IV (40630) | REGAL 330 | 77:22:1 |

The average particle diameter for Examples I to IV was 2.45, 1.7, 2.3 and 2.0, respectively, and the zeta potentials were –451, –413, –564 and –461 millivolts (ESA), respectively.

EXAMPLES V to VII

Second Pass and Precipitation

The pellets of Examples I to IV were fed to the extruder again on an individual color basis in a second pass at 3.9 pounds/hour. Superla NF#5 Mineral Oil (Amoco Corporation) was injected to the upstream port at the #4 barrel section, at approximately 3.9 pounds/hour. The barrel temperature profile was set at 130°/180°/140°/100°/100°/100°/100°/100° C. and the screw speed was 150 rpm. The hot melt from the extruder fell directly into the feed auger of a two inch continuous processor (Teledyne Specialty Equipment - Readco Products, York, Pa.). The continuous processor was cooled by circulating a water/ethylene glycol solution at about 5° C. through its upper and lower jackets. The mixing element speed was about 48 rpm and the exit gate opening was about 0.25 inch. At these conditions, the residence time in the cooled mixer was about one minute and the material temperature midway down the barrel and near the exit was less than 10° C. A granular clumpy solid was recovered in all Examples.

EXAMPLES IX and X

Single Pass Hot Stage and Precipitation

A developer was prepared by dry mixing NUCREL 599®, PV FAST BLUE™ pigment (Example IX) or REGAL 330® carbon black (Example X), and internal charge additive bis(3,5-di-t-butylsalicylato) aluminum hydroxide in the proportions of 77:22:1 by weight, respectively. This blend was then fed into Werner and Pfleiderer ZSK30 twin screw extruder at 3.9 pounds/hour. Superla NF#5 Mineral Oil (Amoco Corporation) was injected to the upstream port at the #4 barrel section, at approximately 3.9 pounds/hour. The barrel temperature profile was set at 150°/150°/150°/150°/130°/130° /130°/130° C. and the screw speed was 300 rpm.

This material was fed directly to the cooled continuous processor and precipitated under the same conditions as Examples V to VIII. A granular clumpy solid was recovered in both Examples.

EXAMPLE XI

Toner Redispersion

For each Example V to X, about 20 grams of material were suspended in a mixture of about 240 grams of Superla Mineral Oil and 250 grams of ISOPAR M™ (Exxon Corporation), and processed by a rotor stator mixer (KINEMATICA® POLYTRON® probe PTA 45/6) at about 8,000 to 12,000 rpm for a total of about 2 minutes. The sample container was maintained in an ice bath and the processing done in two one minute periods with about 5 to 10 minutes between to allow the sample to cool.

EXAMPLE XIII

Toner Evaluation

Following redispersion by the technique of Example XI, the samples of Examples V to X were analyzed for size and charging characteristics by a Horiba CAPA-500 centrifugal automatic particle analyzer and ESA, respectively. The results are summmarized in the following Table.

| TONER ID | PIGMENT | NO. OF PASS IN ZSK30 |
|---|---|---|
| Example V 40621 or 40622 | PALIOTOL YELLOW | 2 |
| Example VI 40624 | FANAL PINK | 2 |
| Example VII 40629 | PV FAST BLUE | 2 |
| Example VIII 40705 | REGAL 330 | 2 |
| Example IX 40627 | PV FAST BLUE | 1 |
| Example X 40704 | REGAL 330 | 1 |

The average particle diameter for Examples V to X was 2.45, 1.71, 2.08, 2.0, 1.5 and 1.7, respectively, and the zeta potentials were −451, −413, −564, −461, −350 and −456 millivolts (ESA), respectively.

EXAMPLE XIII

Toner Redispersion

For Examples V and VII, about 120 grams of material were suspended in about a mixture of 940 grams of Superla Mineral Oil and 1,000 grams of ISOPAR M™ (Exxon Corporation), and processed by a rotor stator mixer (KINEMATICA® POLYTRON® probe PTA 45/6) at about 8,000 to 12,000 rpm for a total of about 9 minutes. The sample container was maintained in an ice bath and the processing done in 3 two minute periods and one three minute period with about 5 to 10 minutes between to allow the sample to cool.

COMPARATIVE EXAMPLE I

Elimination of Second Processor

A developer was prepared by dry mixing NUCREL 599® (a copolymer of ethylene and methacrylic acid with a melt index at 190° C. of 500, available from E.I. DuPont de Nemours & Company, Wilmington, Del.), cyan pigment (PV FAST BLUE™) and internal charge additive aluminum stearate (WITCO 22™) in the proportions of 75:22:3, respectively, by weight. This blend was then fed into Werner and Pfleiderer ZSK30 twin screw extruder at 10 pounds/hour. The extruder barrel temperature profile was 130°/130°/130°/130°/130°/130°/140°/150° C. and the screw speed was 300 rpm. The melt temperature was 166° C. The extruded strands were cooled in a water tank, dried and pelletized. These pellets were fed to the extruder again in a second pass at 5 pounds/hour. NORPAR 15® (Exxon Corporation) was injected to the upstream port at the #4 barrel section, at approximately 5 pounds/hour. The barrel temperature profile was set at 150°/180°/140°/100°/100°/100°/100°/100° C. and the screw speed was 150 rpm. The die plate was removed. The extrudate was collected on large metal trays and allowed to cool to room temperature over the course of about ten to twenty minutes. The large cakes of developer material thus formed were cut into strips approximately one by three inches and fed into a shredder (Black & Decker, Handy Slice 'n Shred) to afford thin slivers of material. About 600 grams of this material were suspended in about 6 liters of NORPAR® and processed in 1 liter batches by a rotor stator mixer (KINEMATICA® POLYTRON® probe PTA 45/6) at about 8,000 rpm for about 2 minutes. A portion of this material was resuspended in NORPAR® and the particle size determined on Horiba CAPA-500 centrifugal automatic particle analyzer. The volume average particle size was found to be 6.44±4.48 microns with over 21 percent of the particles larger than 8.0 microns. These results indicate that without the rapid quenching with mechanical mixing employed in Examples V to X the bulk developer was difficult to process and cannot be redispersed to form the desired toner particle size of, for example, about 2 microns.

Excellent images with high resolutions resulted with the invention liquid developers, and these developers possessed excellent mobilities.

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A process for the preparation of liquid developers consisting essentially of forming a heated dispersion of colorant, thermoplastic resin and carrier liquid, and charge control agent, followed by subsequent cooling of the resulting molten mixture under high shear, and wherein said dispersion is formed by the mixing of said resin, said colorant, and said charge control agent in an extruder, followed by injecting into said extruder carrier liquid, and wherein the exit temperature of the extruder is sufficient to enable the formation of a substantially single phase of said resin and said carrier liquid, and wherien the heated dispersion is maintained at a temperataure of from about 70° to 135° C., and wherein said cooling is accomplished at said exit temperature at from about 20° to about 44° C.

2. A process in accordance with claim 1 wherein the charge control agent is associated with or combined with said resin and said colorant, and there results a solids content of from about 30 to about 80 percent.

3. A process in accordance with claim 1 wherein the dispersion is formed by extrusion.

4. A process in accordance with claim 1 wherein the dispersion is formed in an extrusion device.

5. A process in accordance with claim 1 wherein the charge control agent is an organoaluminum salt.

6. A process in accordance with claim 1 wherein the carrier liquid is an aliphatic hydrocarbon component.

7. A process in accordance with claim 6 wherein the liquid is an aliphatic hydrocarbon, or a mixture of aliphatic hydrocarbons.

8. A process in accordance with claim 1 wherein there results a developer comprised of (A) a liquid with a viscosity of from about 0.5 to about 20 centipoise and resistivity greater than or equal to about $5\times10^9$; (B) thermoplastic resin particles with an average volume particle diameter of from about 0.1 to about 30 microns, charge control agent, and colorant; and further containing (C) a charge director and a charge adjuvant soluble in the carrier liquid.

9. A process in accordance with claim 1 wherein the colorant is present in an amount of about 0.1 to 60 percent by weight based on the total weight of the developer solids of resin, charge control agent, and colorant.

10. A process in accordance with claim 1 wherein the colorant is the pigment carbon black, cyan, magenta, yellow, or mixtures thereof.

11. A process in accordance with claim 1 wherein the charge control agent is present in an amount of from about 0.1 to about 10 weight percent based on the weight of the developer solids.

12. A process in accordance with claim 7 wherein the aliphatic hydrocarbon is comprised of a mixture of branched hydrocarbons with from about 12 to about 20 carbons atoms, or wherein the aliphatic hydrocarbon is comprised of a mixture of normal hydrocarbons with from about 10 to about 20 carbon atoms.

13. A process in accordance with claim 1 wherein the charge control agent is an aluminum salt.

14. A process in accordance with claim 13 wherein the charge control agent is a hydroxy bis[3,5-tertiary butyl salicylic] aluminate monohydrate.

15. A process which consists essentially of dispersing colorant and charge control agent in a molten resin; adding a carrier liquid to from a mixture; retaining the mixture at a temperature to enable the combined liquid and solids to form a molten plastic mass; cooling the resulting mixture under high shear to a temperature where stable solid particles are formed thereby permitting a liquid developer with from about 30 percent to 80 percent solids.

16. A process in accordance with claim 15 wherein the carrier liquid is comprised of a mixture of linear aliphatic hydrocarbons, branched aliphatic hydrocarbons, and cyclic aliphatic hydrocarbons.

17. A process in accordance with claim 15 wherein the temperature is from about 70° to about 140° C.

18. A process for the preparation of a liquid developer consisting of mixing in a nonpolar liquid with thermoplastic resin, charge control agent, and pigment to enable the resulting mixture to contain from about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent cooling the dispersion to about 10° C. to about 50° C.; and adding charge director compound to the dispersion, and thereafter diluting the dispersion to from about 1 percent to about 2 percent solids, and wherein the pigment and charge control agent are dispersed in the liquid and charge director mixture, and wherein the solids contain resin, pigment and charge control agent.

19. A process in accordance with claim 18 wherein cooling is from about 20° to about 44° C.

* * * * *